US006837548B2

(12) United States Patent
Boucherie

(10) Patent No.: US 6,837,548 B2
(45) Date of Patent: Jan. 4, 2005

(54) METHOD FOR MANUFACTURING BRUSHES AND DEVICE FOR CUTTING BRUSH FIBERS USED THEREBY

(75) Inventor: Bart Gerard Boucherie, Izegem (BE)

(73) Assignee: Firma G.B. Boucherie, Naamloze Vennootschap, Izegem (BE)

( * ) Notice: Subject to any disclaimer, the term of this patent is extended or adjusted under 35 U.S.C. 154(b) by 341 days.

(21) Appl. No.: 10/072,936

(22) Filed: Feb. 12, 2002

(65) Prior Publication Data

US 2002/0109396 A1 Aug. 15, 2002

(30) Foreign Application Priority Data

Feb. 13, 2001 (BE) ..... 2001/0100

(51) Int. Cl.[7] ..... A46D 1/06; A46D 9/02
(52) U.S. Cl. ..... 300/17; 300/2; 300/21
(58) Field of Search ..... 300/2, 17, 21

(56) References Cited

U.S. PATENT DOCUMENTS 545,131 A 8/1895 Ohler
3,589,774 A 6/1971 Hazelton
3,871,048 A * 3/1975 Leigh ..... 15/207.2
5,127,290 A * 7/1992 Warner et al. ..... 82/47
5,683,145 A * 11/1997 Boucherie ..... 300/2
2002/0092109 A1 * 7/2002 Edwards et al. ..... 15/207.2

FOREIGN PATENT DOCUMENTS

DE 296 12 491 U1 11/1996
DE 195 28 834 A1 2/1997

* cited by examiner

*Primary Examiner*—Terrence R. Till
*Assistant Examiner*—S Balsis
(74) *Attorney, Agent, or Firm*—Bacon & Thomas, PLLC

(57) ABSTRACT

Method for manufacturing brushes whereby brush bodies are provided with brush fibers and these brush fibers are then cut off by means of a device comprising at least a rotating cutting knife and a counter knife, wherein the brush fibers are cut off by making the cutting knife as well as the counter knife carry out a rotational movement, mainly along one and the same axis of rotation.

6 Claims, 4 Drawing Sheets

METHOD FOR MANUFACTURING BRUSHES AND DEVICE FOR CUTTING BRUSH FIBERS USED THEREBY

BACKGROUND OF THE INVENTION

1. Field of the Invention

The present invention concerns a method for manufacturing brushes, in particular a method whereby a special cutting technique for cutting off the brush fibers is applied, as well as a device for cutting brush fibers used thereby.

The invention is particularly meant to be applied for the manufacturing of tooth brushes, but it is not excluded to use it for the manufacturing of other types of brushes as well.

2. Description of the Related Art

It is generally known that brushes are manufactured by forming brush bodies, by providing these brush bodies with brush fibers and by subsequently cutting off the inserted brush fibers at their free ends at an even height, either or not profiled, possibly combined with other processing stages.

Further, it is customary to use a rotating cutting knife and a fixed counter knife working in conjunction with it for cutting off the brush fibers, whereby these knives can be either or not profiled.

SUMMARY OF THE INVENTION

The invention aims a method for manufacturing brushes, as well as a device for cutting brush fibers used thereby, whereby a special cutting technique is applied, so that several advantages can be obtained in relation to the state of the art, several disadvantages of the known embodiment with a fixed counter knife can be excluded respectively.

To this end, the invention in the first place concerns a method for manufacturing brushes whereby brush bodies are provided with brush fibers. Next, these brush fibers are cut off by means of a device comprising at least a rotating cutting knife and a counter knife, characterized in that the brush fibers are cut off by making the cutting knife as well as the counter knife carry out a rotational movement, mainly along one and the same axis of rotation.

As both knives carry out a rotational movement, a cleaner cut is obtained as well as a cutting effect which is more systematic. Further, the use of a rotating counter knife makes it possible, according to different preferred embodiments, to realize new cutting possibilities which are hard to bring about with a fixed counter knife.

According to a preferred embodiment, the rotating cutting knife and counter knife are driven, at least for a part of the cutting cycle, in an opposite sense of rotation. Thus, even at a relatively low rotational speed of the cutting knife and the counter knife, a relatively large mutual displacement between the cutting edges of both knives is obtained, which results in a higher cutting speed through the fibrous material, which provides a finer cut.

According to one possibility, the rotating cutting knife is driven in one direction while being continuously rotated, while the counter knife is driven in the opposite direction while being continuously rotated. This possibility offers the advantage that the drives can be kept relatively simple.

According to another possibility, both knives are driven in the same sense of rotation, but at a different rotational speed.

According to another possibility, at least one of both knives, either the cutting knife or the counter knife, is driven with an oscillating movement, thus rotating back and forth, while the other knife is preferably driven in a continuously rotating manner. In particular, the cutting knife will be driven while being continuously rotated, whereas the counter knife is displaced in an oscillating manner. This possibility makes it possible, for example, for the counter knife to be displaced exclusively back and forth in the zone where the brush fibers are situated, so that this counter knife does not have to carry out an unnecessary complete rotation.

According to the most preferred embodiment, the rotating cutting knife and counter knife are driven such in relation to one another that the successively formed intersections, successively formed intersecting lines respectively, move according to a rotating path.

By making sure that these intersections are moved sufficiently fast, one obtains that practically anywhere along the theoretical cylindrical jacket around the rotating cutting knife is obtained a cutting effect, as a result of which several disadvantages which are typical when using a fixed counter knife can be excluded. One of these disadvantages is for example that, with a fixed counter knife, and thus with a stationary intersecting line, the cutting edges of the rotating cutting knife must first move over a certain distance through the brush fibers before a cut is realized, whereby the brush fibers can be damaged during this movement.

According to a practical embodiment, use is preferably made of a rotating cutting knife with several cutting edges and/or use is made of several counter knives working in conjunction with one and the same cutting knife. Thus, it is possible to realize a larger number of cuts per unit of time, without an increase of the rotational speeds of the knives being required.

According to a special embodiment of the above-mentioned method, the brush fibers are provided with a profile by altering the distance between the rotating cutting knife and the brush body of the brushes to be cut, so that the cutting knife penetrates deeper or less deep in the fiber pack, either or not combined with other mutual displacements. Thus can be created a profiled design without profiled knives being absolutely necessary, which is required for practical reasons, however, when making use of a fixed counter knife.

What precedes does not exclude, however, that profiled knives can also be used when making use of a rotating counter knife. The combined use of a rotating counter knife which on top of that is profiled, offers additional new possibilities as such, such as for example the realization of three-dimensional profiles.

The invention also concerns a device for cutting brush fibers, of the type comprising at least one rotating cutting knife and at least one counter knife, characterized in that the counter knife can also be moved, in particular can be rotated.

Other preferred characteristics of the method and the device according to the invention are described in the following detailed description and in the accompanying claims.

BRIEF DESCRIPTION OF THE DRAWINGS

In order to better explain the characteristics of the invention, the following preferred embodiments are described as an example only without being limitative in any way, with reference to the accompanying drawings, in which.

DESCRIPTION OF PREFERRED EMBODIMENTS

Figure 1:
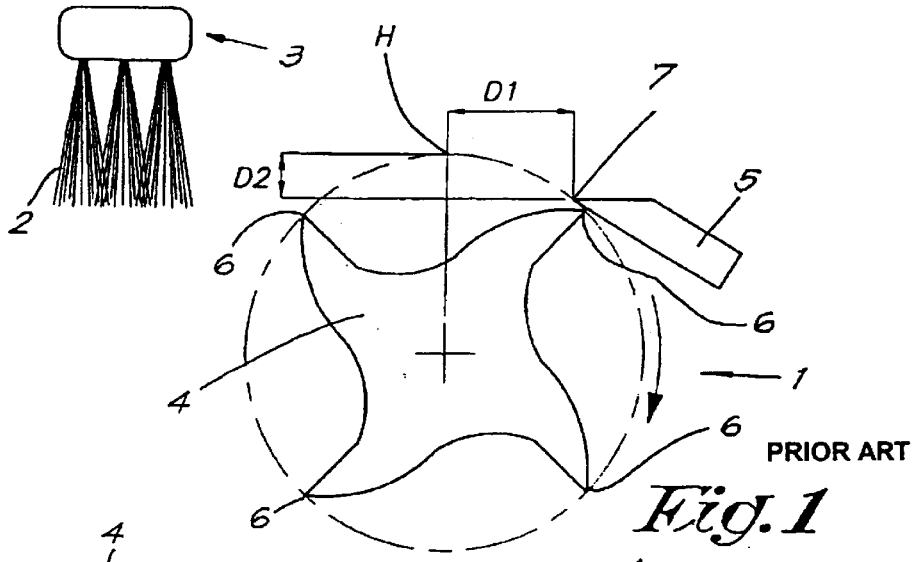
FIG. 1 schematically represents a known embodiment of a device for cutting brush fibers, with a fixed counter knife.

FIG. 1 represents a known embodiment of a device 1 for cutting brush fibers 2 of brushes 3, consisting of a cutting knife 4 which can rotate around an axis, and a fixed counter knife 5. The cutting knife 4 has several cutting edges 6 which alternately work in conjunction with a cutting edge 7 formed on the counter knife 5.

It is clear that the counter knife 5 must be erected such that it touches the turning circle of the cutting edges 6, whereas, moreover, the counter knife 5 with the cutting edge 7 is preferably situated off center at a distance D1, and thus also at a distance D2 under the highest point H. In the case of a fixed counter knife 5, this is necessary to make sure that the cut off brush fibers are not hindered by the counter knife 5 during the displacement of the brush 3 along the device 1.

Also, a disadvantage of this known erection consists in that the cutting edges 6 rotate up to a depth D2 through the brush fibers 2 and so to say hack at them, so that the fiber brushes 2 can be damaged.

Figure 2:
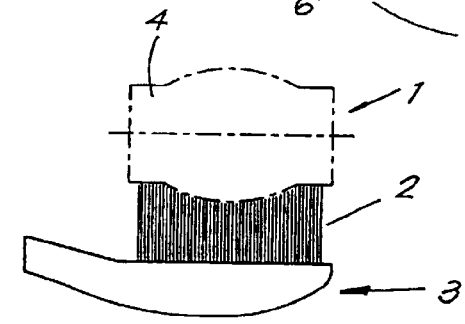
FIGS. 2 and 3 schematically represent two more known embodiments.
Figure 3:
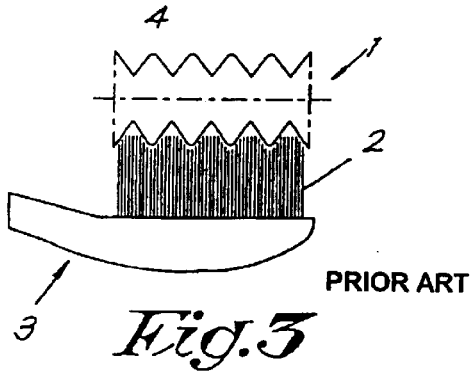

Such a device 1 with a fixed counter knife 5 is moreover disadvantageous in that it is almost impossible to obtain a profiled shape with a straight counter knife 5. Also, in practice, this is only possible by making use of a profiled cutting knife 4 and counter knife 5, for example as is schematically represented in FIGS. 2 and 3. Such profiled knives are disadvantageous, however, in that they are difficult to produce, to adjust and to sharpen. Moreover, it is difficult to obtain a clear cut, in other words a cut whereby no burrs remain on the far ends of the cut fibers, which burrs will in turn hinder the rounding of the fiber ends.

As mentioned above, the invention aims a device 8 offering new possibilities whereby, irrespective of the application and embodiment, the above-described disadvantages can be excluded.

Figure 4:
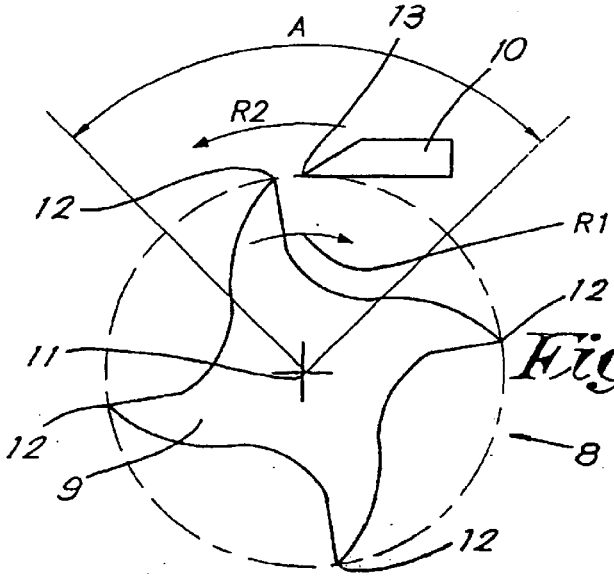
FIG. 4 schematically represents a device according to the invention.

As is schematically represented in FIG. 4, such a device 8 not only comprises a rotating cutting knife 9, but also a counter knife 10 which can be moved, in particular rotated, whereby the cutting knife 9 and counter knife 10 can rotate around the same axis of rotation 11.

The rotating cutting knife 9 can be formed in a conventional manner with several cutting edges 12, in this case four in total, working in conjunction with the cutting edge 13 of the fixed counter knife 10. It is clear, however, that cutting knives 9 with another number of cutting edges 12 can be applied, and that this cutting knife 9 can in principle also have but one cutting edge 12.

Figure 5:
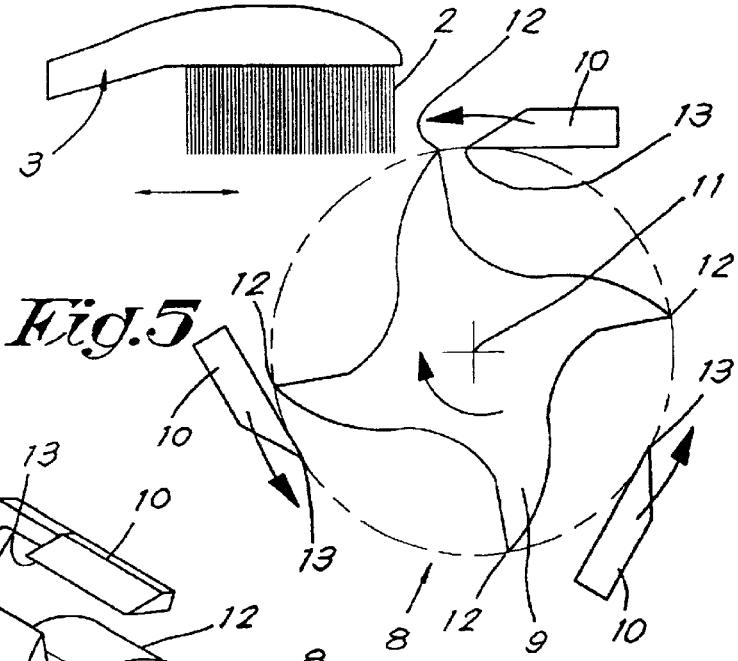
FIG. 5 represents a variant of a device according to the invention.
Figure 6:
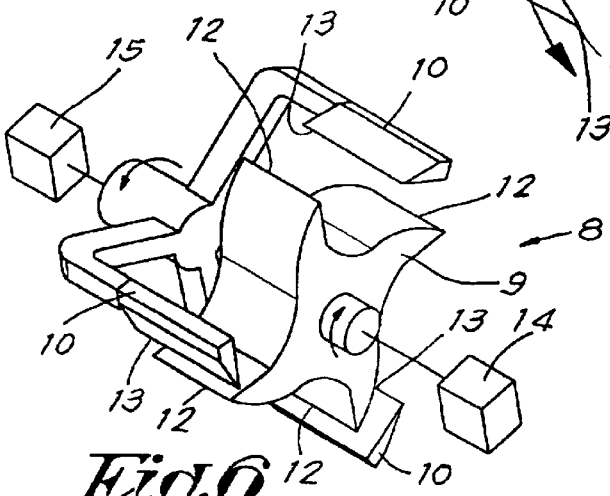
FIG. 6 represents the device from FIG. 5 in perspective.

In the embodiment of FIG. 4 is provided only one counter knife 10, but it is clear that, according to a variant, several counter knives 10 can be used working in conjunction with the same rotating cutting knife 9, for example as represented in the embodiment of FIGS. 5 and 6.

The cutting knife 9 and the counter knife 10, the counter knives 10 respectively, can be driven in different ways, but naturally always in such a manner that there is a mutual displacement between the cutting edges 12 and the cutting edge 13, cutting edges 13 respectively.

The knives 9 and 10 can be driven in an opposite sense of rotation, for example R1 and R2, as indicated in FIG. 4 and 5. According to a variant, they can also be driven in the same sense of rotation, but at a different rotational speed.

Instead of driving every knife, cutting knife 9 and counter knife 10 respectively, always in the same sense of rotation, either or not opposite to one another, it is also possible to drive one of both knives in an oscillating manner in an alternating sense of rotation. In this case, the counter knife 10 will preferably oscillate, whereas the cutting knife will continuously rotate. This implies that, for example in FIG. 4, the counter knife 10 is turned back and forth at an angle A, while the cutting knife 9 always rotates in the same sense.

It is clear that the rotational movements can be obtained by any type of driving means whatsoever. FIG. 6 schematically represents two separate driving elements 14 and 15 for the cutting knife 9 and counter knife 10 respectively. It is clear, however, that also a common driving element can be applied whereby the cutting knife 9 and the counter knife 10 are then coupled to this driving element via suitable transmissions.

Figure 7:
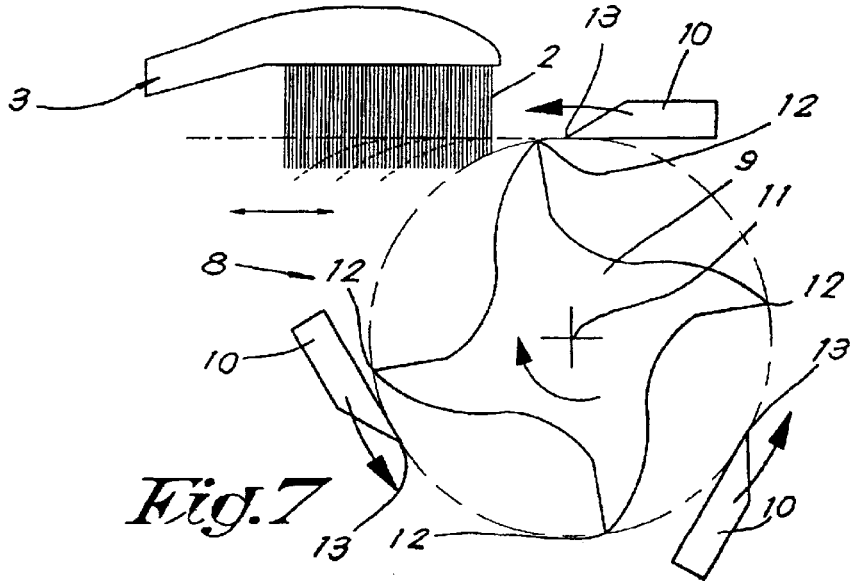
FIGS. 7 and 8 schematically represent two applications of a device according to the invention.

The working of the device 8 and the ensuing method for cutting off the brush fibers 2 can be easily derived from the figures. It is clear that, by displacing the device 8 and a brush 3 in relation to one another, along one another, the brush fibers 2 are cut off on the spots where the cutting edges 12 and 13 work in conjunction with one another. Naturally, in reality, the mutual displacement is carried out automatically. FIG. 7 shows how a flat cut can be obtained by means of a parallel mutual displacement between a brush 3 and the device 8 concerned. In the given example, the device 8 is situated with its axial axis, in other words the axis of rotation 11, across the longitudinal direction of the fiber pack, consisting of brush fibers 2 to be cut. It is clear, however, that other erections are possible.

Figure 8:
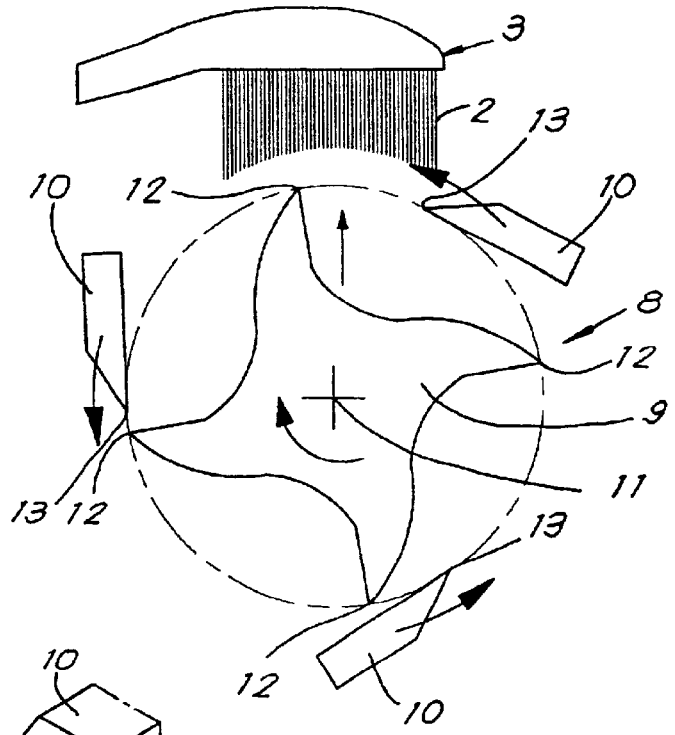

FIG. 8 shows that, by making use of the present invention, it is also easy to obtain a profile with a straight counter knife 10, or at least a counter knife 10 whose cutting edge 13 is situated on a cylindrical jacket, profile, which in this case consists of an excavation 16, is hereby obtained by displacing the device 8 towards the brush 3, so that the cutting knife 9 penetrates into the fiber pack up to a certain depth.

Figure 9:
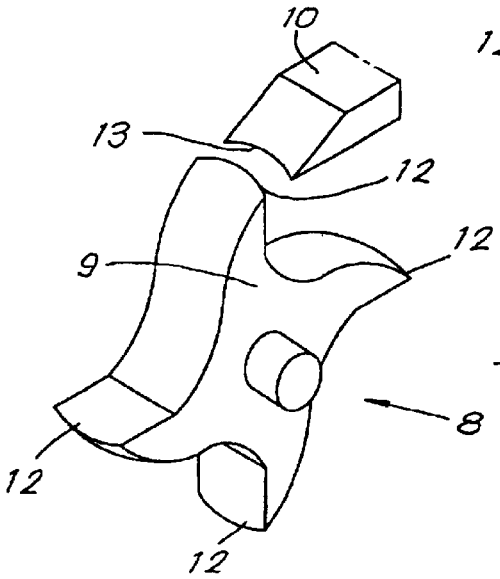
FIG. 9 schematically represents another variant.
Figure 11:
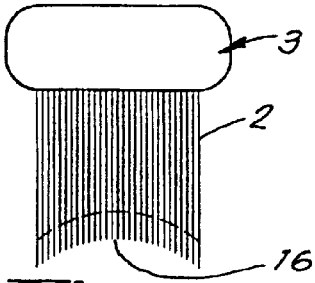
FIGS. 10 and 11 represent views of a tooth brush whose brush fibers have been cut off by means of the device from FIG. 9.
Figure 10:
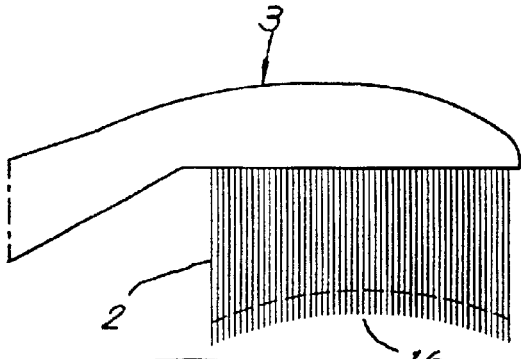

However, what precedes does not exclude that also in the device 8 of the invention, use can be made of a profiled cutting knife 9 and a profiled counter knife 10. FIG. 9 shows an example thereof, while FIGS. 10 and 11 represent a brush 3 which is made by means of the profiled cutting knife 9 and the profiled counter knife 10 of FIG. 9.

It is clear that, thanks to the combination of the above-mentioned movements and the use of a device 8 with profiled knives, one obtains a whole lot of possibilities to realize complicated profiles in a smooth manner.

Figure 12:
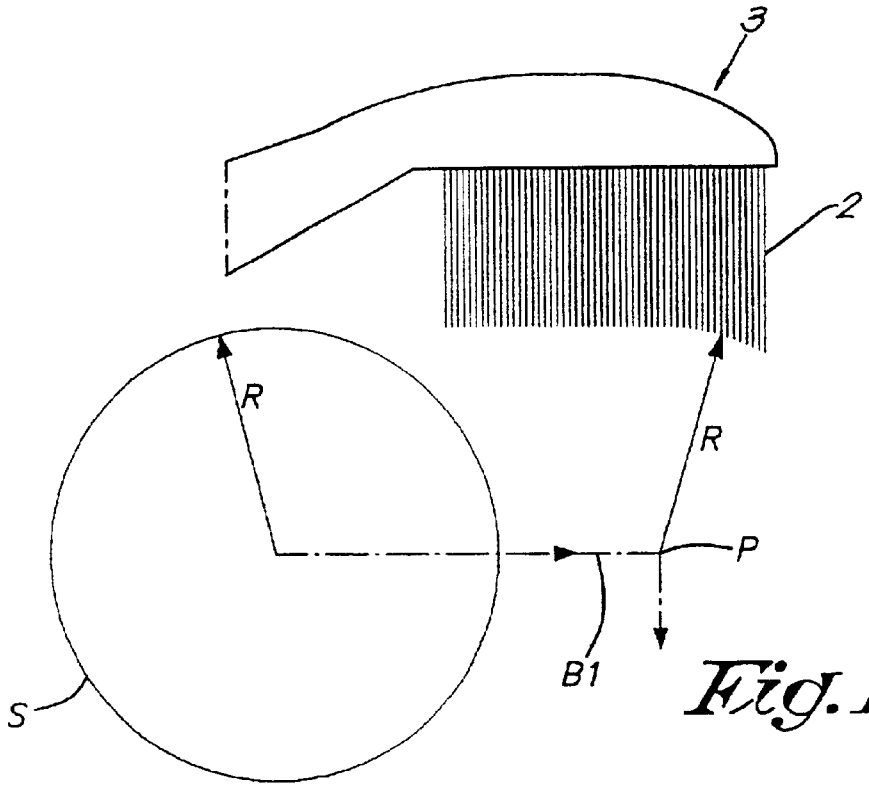
FIGS. 12 and 13 schematically represent two more applications of the invention.

In order to realize a profiled shape, it is also possible to move the rotating cutting knife 9 according to a straight path along the brush 3, either at an angle, either up to a given place. The latter is schematically represented in FIG. 12, whereby the cutting knife 9, having a radius R, and thus the intersecting circle S, is moved via a straight path B1 up to a particular place P, to be subsequently moved away from the brush 3.

Figure 13:
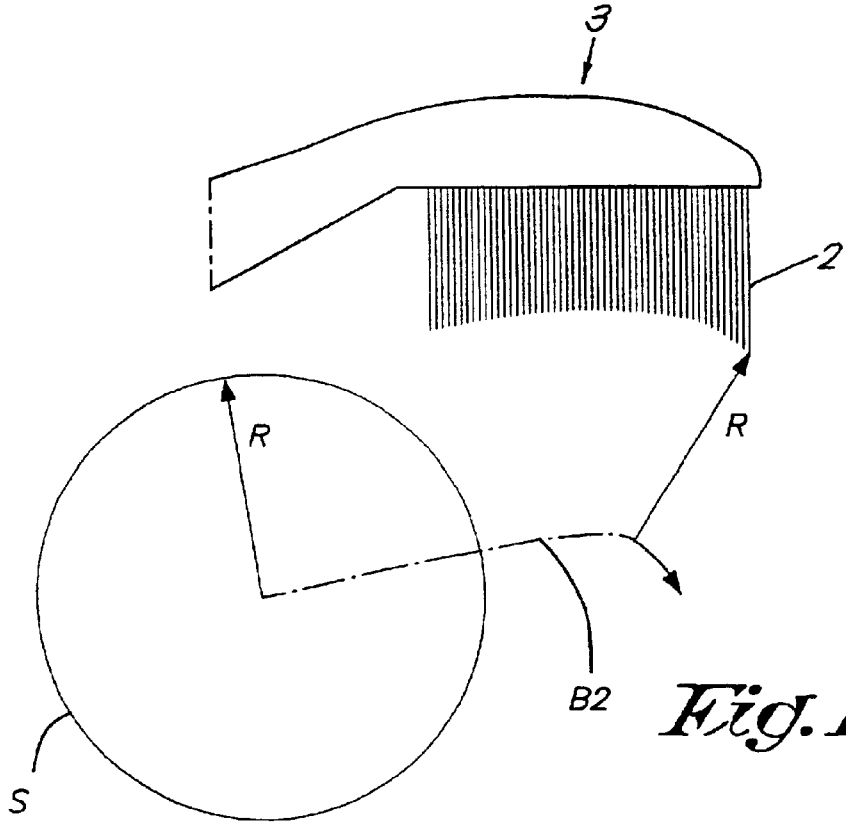

It is also possible to displace the cutting knife 9 along the brush 3 according to a controlled path, in particular a non-straight path or an interrupted path, for example as is schematically represented by path B2 in FIG. 13.

It is clear that by all the above-mentioned displacements are meant mutual displacements. Thus, the brush 3 as well as the device 8, or both, can be moved in order to obtain the required mutual displacement. The means for realizing these displacements can be of a different nature, but they essentially consist of driven mechanisms of movement to displace either the cutting knife, the brushes or both.

The invention is by no means limited to the above-described embodiments represented in the accompanying drawings; on the contrary, such a method for manufacturing brushes and the device used thereby for cutting brush fibers can be made in all sorts of variants while still remaining within the scope of the invention.

What is claimed is:

1. A method for manufacturing brushes comprising the steps of: providing brush bodies with brush fibers; cutting the brush fibers by means of a device including at least one rotating cutting knife and at least one counter knife cooperating with the at least one rotating cutting knife; cutting off the brush fibers by making the cutting knife and the counter knife carry out a rotational movement along one and the same axis of rotation.

2. The method according to claim 1, wherein the rotating knife and the counter knife, are driven in at least one of the following ways:

such that the rotating cutting knife and the counter knife move in the opposite sense of rotation, at least for a part of the cutting cycle;

such that the rotating cutting knife moves continuously rotating in one direction and such that the counter knife moves continuously rotating in the opposite direction;

such that the rotating cutting knife and the counter knife are moved, at least for a part of the cutting cycle, in the same sense of rotation but at a different rotational speed;

such that at least one of the cutting knife and/or the counter knife, are displaced with an oscillating movement, so as to rotate back and forth; and such that the cutting knife and the counter knife are driven at different rotational speeds.

3. The method according to claim 1, wherein use is made of a rotating cutting knife with several cutting edges and/or of several counter knives.

4. The method according to claim 1, wherein the device for cutting the brush fibers and the brushes to be cut, in order to cover a fiber pack comprising the brush fibers, are mutually moved along one another.

5. The method according to claim 1, further comprising the step of extending the device for cutting the brush fibers with the axial axis thereof in relation to the longitudinal direction of a fiber pack comprising the brush fibers.

6. The method according to claim 1, wherein the brush fibers are provided with a profile formed by at least one of the following two techniques or the combination thereof:

the use of a profiled rotating cutting knife and a counter knife working in conjunction therewith;

altering the distance between the rotating cutting knife and the brush body of the brushes to be cut, such that the cutting knife penetrates deeper or less deep in a fiber pack comprising the brush fibers.

* * * * *